United States Patent [19]

Bradley

[11] 4,400,036

[45] Aug. 23, 1983

[54] CORNER-CUTTING MINING ASSEMBLY

[75] Inventor: John A. Bradley, San Antonio, Tex. granted to the U.S. Department of Energy under the provisions of 42 U.S.C. 2182

[73] Assignee: The United States of America as represented by the U.S. Department of Energy, Washington, D.C.

[21] Appl. No.: 279,391

[22] Filed: Jul. 1, 1981

[51] Int. Cl.[3] ..... E21C 27/24

[52] U.S. Cl. ..... 299/86; 175/91; 299/59

[58] Field of Search ..... 299/18, 56, 57, 59, 299/60, 86; 175/91, 319

[56] References Cited

U.S. PATENT DOCUMENTS

| | | | |
|---|---|---|---|
| 2,561,343 | 7/1951 | Crossley | 175/319 X |
| 2,733,057 | 1/1956 | Letts | 299/57 |
| 2,950,902 | 8/1960 | Olds | 175/91 |
| 3,945,445 | 3/1976 | Ikeda | 175/319 |

*Primary Examiner*—Ernest R. Purser

*Attorney, Agent, or Firm*—Edwin D. Grant; Stephen D. Hamel; Richard G. Besha

[57] ABSTRACT

A mining assembly includes a primary rotary cutter mounted on one end of a support shaft and four secondary rotary cutters carried on the same support shaft and positioned behind the primary cutters for cutting corners in the hole cut by the latter.

5 Claims, 4 Drawing Figures

CORNER-CUTTING MINING ASSEMBLY

BACKGROUND OF THE INVENTION

This invention resulted from a contract with the United States Department of Energy and relates to a mining tool. More particularly, the invention relates to an assembly capable of drilling a hole having a square cross-sectional shape with radiused corners.

In mining operations in which conventional auger-type drills are used to form a series of parallel, cylindrical holes in a coal seam, a large amount of coal remains in place in the seam because the shape of the holes leaves thick webs between the holes. A higher percentage of coal can be mined from a seam by a means capable of drilling holes having a substantially square cross section.

SUMMARY OF THE INVENTION

It is an object of this invention to provide an improved mining apparatus by means of which the amount of coal recovered from a seam deposit can be increased.

Another object of the invention is to provide a drilling assembly which cuts corners in a hole having a circular cross section.

These objects and other advantages are attained by a preferred embodiment of the invention comprising a cylindrical primary cutter coaxially fixed on one end of a cylindrical support shaft and a hub rotatably mounted on the support shaft adjacent the primary cutter. Four support arms are evenly spaced apart from one another circumferentially of the aforesaid hub and project radially outward therefrom beyond the perimeter of the primary cutter. Four cylindrical secondary cutters are respectively mounted on the support arms for rotation about axes parallel with the longitudinal axis of the support shaft, these secondary cutters being driven by a drive means which includes sprocket wheels and a chain engaged with the latter. The secondary cutters have the same diameter, which is less than that of the primary cutter, and they are located between the support arms and the primary cutter. When rotated by the drive means, the secondary cutters cut four corner-forming grooves in the wall of the hole cut by the primary cutter. Mounted on the outer end of each support arm is an arcuate guide shoe the outer surface of which is positioned and shaped to conformably engage the wall of the groove cut by the secondary cutter mounted on the same support arm.

DETAILED DESCRIPTION OF THE PREFERRED EMBODIMENT

Figure 2:
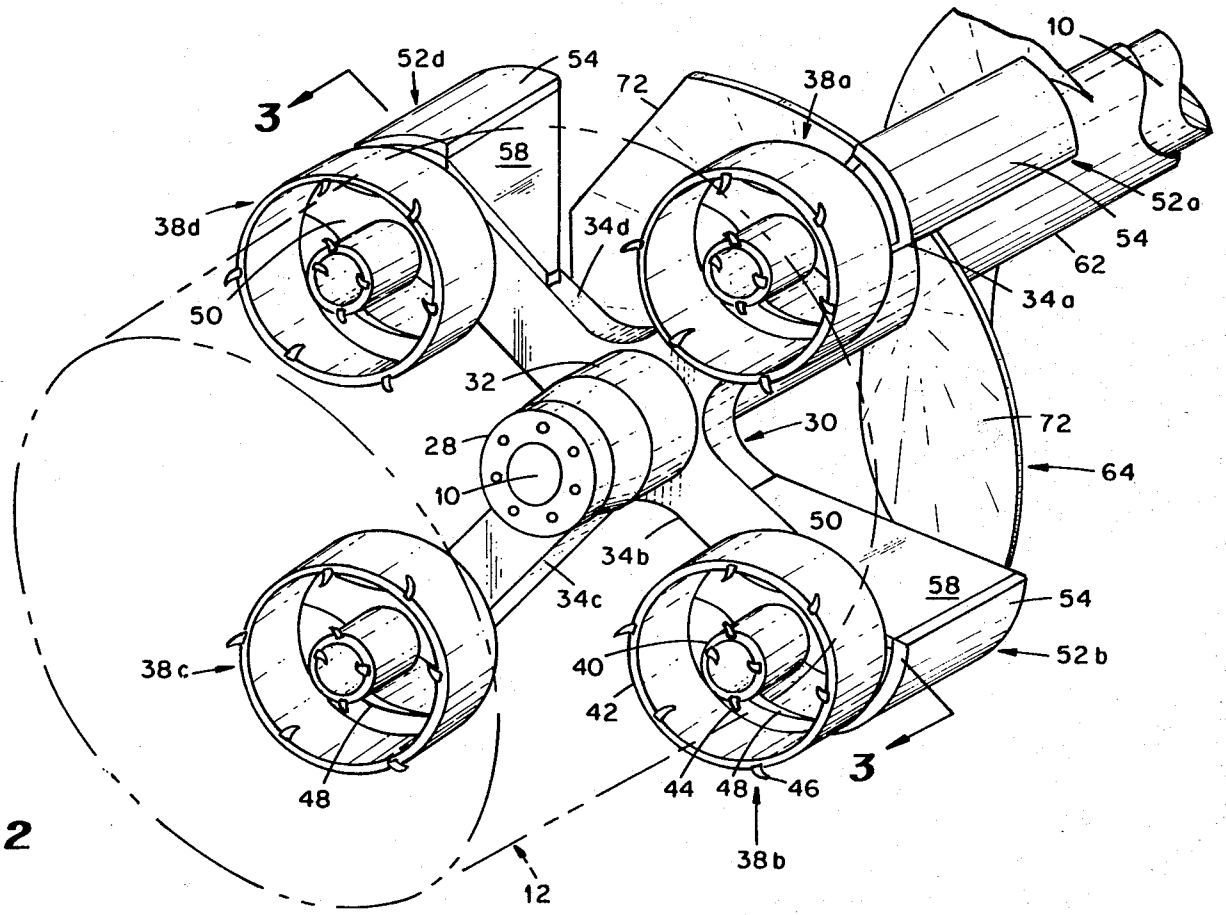
FIG. 2 is an enlarged view of some of the components illustrated in FIG. 1, a primary cutter of the cutting assembly being represented therein by broken lines.

The preferred embodiment of the invention includes a cylindrical support shaft 10 (see FIGS. 2 and 3) one end of which is mounted in a conventional drive means (not shown) that rotates the support shaft about its longitudinal axis and also reciprocates it in either direction along its longitudinal axis. Fixedly mounted on the opposite, forward end of support shaft 10 is a conventional rotary cutter generally designated by reference number 12 and provided with a core cutter barrel 14, an outer cutter barrel 16, a plurality of cutter bits 18, 20 respectively attached to the forward edges of said inner and outer barrels, a kerf breaker 22 extending between said inner and outer barrels, a core breaker 24 mounted inside said inner barrel, and arms 26 extending between said inner and outer barrels. Cutter 12, which will be referred to hereinafter as the primary cutter, is attached by bolts (not shown) to a flange 28 (see FIG. 2) fixedly secured to the forward end of support shaft 10.

Reference number 30 generally designates a support frame comprising a hub 32 which is rotatably mounted on a reduced-diameter forward end portion of support shaft 10 and engaged with the rear face of flange 28. Fixedly attached to the end of hub 32 remote from primary cutter 12 is a housing comprising four support arms 34*a*–34*d* which are evenly spaced apart from one another circumferentially of the hub and which project radially outward therefrom beyond the perimeter of the outer cutter barrel 16 of the primary cutter. Four shafts 36*a*–36*d* (see FIG. 3) are respectively journaled in the walls of support arms 34*a*–34*d* which face primary cutter 12 and project forwardly therefrom with their longitudinal axes parallel with the longitudinal axes of support shaft 10. Four secondary rotary cutters are respectively coaxially mounted on shafts 36*a*–36*d* and lie between support arms 34*a*–34*d* and primary cutter 12, these cutters being generally designated by reference numbers 38*a*–38*d* and each comprising an inner barrel 40, an outer barrel 42, a plurality of cutter bits 44, 46 respectively attached to the forward edges of said inner and outer barrels, a kerf breaker 48 and arms 50 extending between said inner and outer barrels. The outside diameters of outer barrels 42 are the same, and in the illustrated embodiment each outer barrel 42 has an outside diameter that is slightly less than one-third of the outside diameter of outer barrel 16 of primary cutter 12.

Respectively mounted on the outer ends of support arms 34*a*–34*d* are four elongate, arcuate guide shoes which are respectively generally designated by reference numbers 52*a*–52*d*. The outer surface 54 of each guide shoe is shaped in the form of a longitudinal segment of a cylinder substantially coaxial with and having the diameter of the outer surface of the support barrel 42 of the adjacent secondary cutter 38*a*–38*d*. More particularly, the outer surface 54 of each guide shoe 52*a*–52*b* is positioned and shaped to conformably engage the wall of the groove 56 (see FIGS. 1 and 4) cut by the secondary cutter 38*a*–38*d* mounted on the same support arm 34*a*–34*d*. Triangular brace plates 58 are attached to guide shoes 52*a*–52*d* and the respective support arms 34*a*–34*d* associated therewith.

Figure 3:
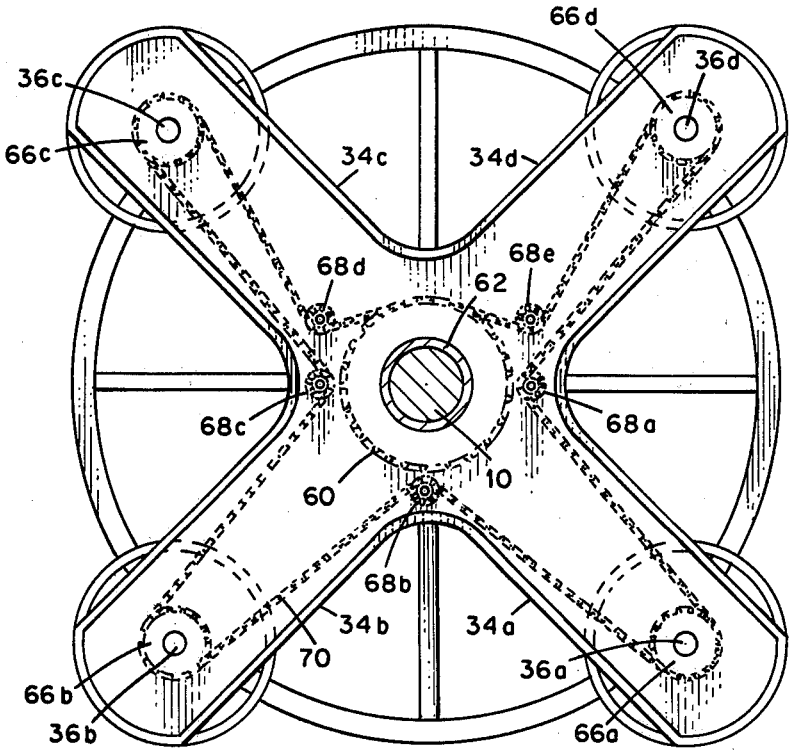
FIG. 3 is a cross-sectional view of components of the preferred embodiment, taken along the plane represented by line 3—3 in FIG. 2 and in the direction indicated by arrows associated with said line.

As illustrated in FIG. 3, a primary sprocket wheel 60 is fixedly mounted on the forward end of the support tube 62 of a screw conveyer generally designated by reference number 64, tube 62 being rotatably mounted on support shaft 10 with its forward end extending through a bearing (not shown) in the rear wall of the housing of support frame 30 and the primary sprocket wheel also being positioned within said housing. Secondary sprocket wheels 66*a*–66*d* are respectively fixedly attached to shafts 36*a*–36*d*, and idler sprockets 68*a*–68*e* are rotatably mounted inside support frame 30. A drive chain 70 engages the primary, secondary, and idler sprocket wheels as illustrated.

A helical wall 72 extends around tube 62, the forward end of this wall terminating adjacent support frame 30. Tube 62 is rotated by conventional drive gearing (not shown) associated with the means which rotates support shaft 10.

OPERATION OF THE PREFERRED EMBODIMENTS OF THE INVENTION

Figure 1:
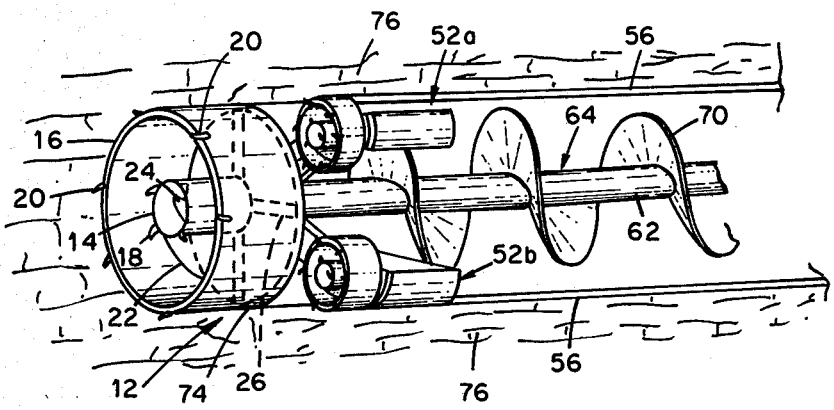
FIG. 1 is a pictorial view of a preferred embodiment of the invention.

FIG. 1 reference number 74 designates the bore hole cut by primary cutter 12 as support shaft 10 is rotated and advanced along its longitudinal axis into mined material 76. As bore hole 74 is being cut, screw conveyor 64 is being rotated about support shaft 10 in the direction which conveys cut material away from the primary cutter. Rotation of the support tube 62 of screw conveyor 64 turns primary sprocket wheel 60 mounted thereon, and drive chain 70 thus turns secondary sprockets 66*a*–66*d* attached to secondary cutters 38*a*–38*d*. Each secondary cutter cuts a corner-forming groove 56 in the wall of the bore hole 74 cut by primary cutter 12. Hence, primary cutter 12 and secondary cutters 38*a*–38*d* together cut a hole 78 (see FIG. 4, wherein two holes cut by the described cutting assembly are illustrated in cross section) having a quadrilateral cross-sectional shape.

The outer surfaces 54 of guide shoes 52*a*–52*d* respectively engage the walls of the grooves 56 cut by secondary cutters 38*a*–38*d* in bore hole 74. Support frame 30 is therefore prevented from turning as the cutting assembly is advanced into the mined material 76.

Figure 4:
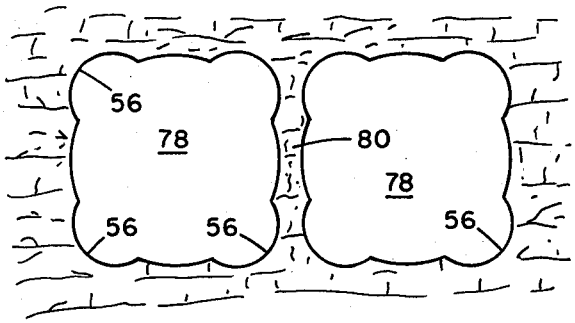
FIG. 4 is a view illustrating the cross-sectional shape of holes cut by the illustrated cutting assembly.

It will be seen in FIG. 4 that the disclosed cutting assembly can cut adjacent holes 78 having a thin web 80 therebetween. The cutting assembly thus provides an effective means for recovering a high percentage of coal or other mined material from a deposit thereof.

What is claimed is:

1. A corner-cutting mining assembly comprising:

a cylindrical support shaft;

a primary rotary cutter fixedly mounted on one end of said support shaft for cutting a cylindrical bore hole in mined material coaxial with said support shaft when the latter is rotated about its longitudinal axis and advanced into said material by movement along its longitudinal axis;

a support frame comprising (1) a hub rotatably mounted on said support shaft adjacent said primary cutter, and (2) four support arms evenly spaced apart from one another circumferentially of said hub and projecting radially outward therefrom beyond the perimeter of said bore hole;

four secondary rotary cutters respectively mounted on said support arms for rotation about axes parallel with the longitudinal axis of said support shaft, said secondary cutters being disposed between said support arms and said primary cutter, said secondary cutters having identical diameters less than that of said primary cutter and cutting, when rotated, corner-forming grooves in the wall of said bore hole cut by said primary cutter, whereby said primary and secondary cutters together cut a hole having a quadrilateral cross-sectional shape;

means for rotating said secondary cutters; and a screw conveyor rotatably mounted on said support shaft on the side of said support frame remote from said cutters.

2. The assembly of claim 1 wherein each of said cutters comprises:

a barrel; and a plurality of cutter bits mounted on said barrel.

3. The assembly of claim 2 including an arcuate guide shoe mounted on each of said support arms with its outer surface positioned and shaped to conformably engage the wall of the groove cut by the secondary cutter mounted on the same support arm.

4. The assembly of claim 3 wherein said means for rotating said secondary cutters comprises:

a primary sprocket wheel fixedly attached to said screw conveyor;

secondary sprocket wheels respectively fixedly attached to said secondary cutters; and a drive chain engaged with said primary and secondary sprocket wheels.

5. The assembly of claim 4 wherein:

each of said support arms is hollow;

said secondary sprocket wheels are respectively disposed inside said support arms; and said drive chain extends into each of said support arms.

* * * * *